United States Patent [19]

McDonald et al.

[11] 4,337,557

[45] Jul. 6, 1982

[54] METHOD AND APPARATUS FOR TEXTURIZING THERMOPLASTIC YARN

[75] Inventors: William J. McDonald, Belfast; Brian Robinson, Clough, both of Northern Ireland

[73] Assignee: James Mackie & Sons Limited, Belfast, Northern Ireland

[21] Appl. No.: 267,529

[22] Filed: May 27, 1981

Related U.S. Application Data

[63] Continuation of Ser. No. 148,146, May 9, 1980, abandoned.

[30] Foreign Application Priority Data

May 18, 1979 [GB] United Kingdom ..... 7917326

[51] Int. Cl.[3] ..... D02G 1/12

[52] U.S. Cl. ..... 28/250; 28/254; 28/255; 28/264

[58] Field of Search ..... 28/249, 250, 254, 255, 28/256, 264

[56] References Cited

U.S. PATENT DOCUMENTS 3,961,401 6/1976 Ferrier et al. ..... 28/249

3,961,402 6/1976 Ferrier et al. ..... 28/250

*Primary Examiner*—Robert Mackey

*Attorney, Agent, or Firm*—Larson & Taylor

[57] ABSTRACT

Thermoplastic yarn is texturized by the known method of forwarding it in a heated condition to a crimping zone at the entrance of a stuffer chamber (7) so as to form a plug (8) of crimped yarn within the chamber and withdrawing the yarn from the other end of the plug at a speed which is related to the input speed. The improvement comprises deriving signals from the speed of the yarn plug (8) in the stuffer chamber (7) by means of a sensing wheel (11) which drives a gapped monitoring disc (13). The disc (13) operates to intercept a beam of light from a source (14) which is directed on to a photo-sensor (15). The output of the photo-sensor is supplied to an electrical controller (36) which measures the time during which light is received for each gap in the disc (13) to provide a measure of the speed of the yarn plug. The resultant signals are used to control the temperature of the yarn passing to the crimping zone in such a way as to maintain the speed and hence the quality of the bulk yarn substantially constant. For this purpose, the signals from the controller (36) are fed to a heater controller (28) to adjust the current to a heating element (5) in a chamber (4) through which steam passes before feeding the yarn (1) through a jet passage (2) leading to the chamber (7).

15 Claims, 4 Drawing Figures

METHOD AND APPARATUS FOR TEXTURIZING THERMOPLASTIC YARN

This is a continuation of the application Ser. No. 148,146 filed May 9, 1980, now abandoned.

This invention relates to the texturizing of yarn and is particularly concerned with a form of process for this purpose in which the yarn is forwarded in a heated condition into a stuffer chamber either mechanically or by a jet of fluid or gas under pressure, and packed upon itself to form a crimp plug. The stuffer chamber is normally of tubular form and arranged vertically, the yarn being injected at the bottom and, after travelling up the tube in the form of the crimp plug, being continuously removed from the top of the plug. The yarn may receive an initial texturizing treatment during its passage to the stuffer chamber. For example, when using a jet of fluid or gas for forwarding the yarn, the construction of the jet apparatus may be such as to bulk the yarn. Even if all the operating conditions, i.e. the rate of feed of the yarn to the bottom of the plug and the rate of withdrawal from the top of the plug of crimped yarn and also the temperature and velocity of the jet are kept constant, it is found that the height of the plug fluctuates continuously.

In the past, the effect of fluctuating plug height was compensated for by corresponding adjustment of either the rate of feed or withdrawal of the yarn. For this purpose, the height of the plug was monitored and any departures from a datum value used to exert the required control. This, however, merely treated the symptoms rather than the cause of the fluctuations. It was subsequently realized that the cause of the fluctuations was due to variations in the degree of bulking arising from variations in yarn quality and hence in the height of the plug. Moreover, these variations in quality subsequently manifested themselves in the finished yarn, particularly in the form of variations of dyeability which was readily noticeable in the final product.

It was found that these variations in quality could be controlled by varying the temperature of the yarn in its passage to the crimping zone at the bottom of the stuffer chamber. Not only does this lead to much greater uniformity in the properties of the finished yarn, e.g. dyeability as mentioned above, but it also leads to much greater consistency in the bulk and hence in the plug height. Consequently, by monitoring plug height as in the past, signals could be derived for effecting the temperature control.

The invention is thus concerned with an improvement in a method of texturizing thermoplastic yarn by forwarding it in a heated condition to a crimping zone at the entrance of a stuffer chamber so as to form a plug of crimped yarn within the chamber and withdrawing the yarn from the other end of the plug at a speed which is related to the input speed, and according to the invention, signals for controlling the yarn temperature in such a way as to maintain the speed and hence the quality of the bulk yarn substantially constant are derived by monitoring the speed of the yarn plug. For this purpose, a value corresponding to the speed at any instant may be compared to a datum value, i.e. a value corresponding to a datum speed to produce the desired degree of bulk, the difference between the two being used to adjust the yarn temperature in the appropriate direction. It will be understood that for a constant speed of yarn feed, the speed of the yarn plug will depend on the degree of texturizing, so that too high a speed will indicate too low a degree of texturizing and will call for an increase of temperature; conversely, too low a speed will call for a decrease of temperature. In other words, measurement of the speed of the yarn plug will provide a measure of the yarn quality and will hence indicate any correction required.

A measure of the speed of the plug may be obtained by means of a sensing wheel or similar rotary member pressed against the side of the plug. In the absence of slip, the speed of rotation will provide a measure of the speed of movement of the plug and can be used to provide the required control signals. For example, a sensing wheel may drive a gapped member such as a slotted disc or toothed wheel which intercepts a beam of radiation incident on a photo-electric sensor. Preferably such an arrangement is utilized by measuring the time during which radiation is received by the sensor during each gap in the member. The higher the speed of rotation, the less the time during which radiation is received so that the two quantities. bear an inverse relation to one another. Alternatively, the frequency of the alternating signal from the photo-electric sensor may be measured, this varying directly with the speed of the plug.

The former alternative is preferred and the period of transmission of radiation (conveniently visible light) during each gap in the member is preferably measured by connecting the output from the sensor to charge a capacitor operating on the straight-line portion of its charging curve so that the voltage to which the capacitor is charged varies directly with the period of radiation transmission and hence inversely with the speed of the plug. Thus the capacitor may be charged from a source of constant voltage via a switch controlled by the output of the sensor so as to give a voltage dependent on the duration of each period of radiation reception. This voltage may then be compared with a datum voltage, i.e. a voltage corresponding to a datum speed of plug. If the capacitor voltage is greater than the datum voltage, the plug speed must be below the datum speed and the yarn temperature needs to be decreased. Similarly, if the capacitor voltage is below the datum voltage, the yarn temperature needs to be increased.

This is conveniently determined by means of a comparator having one input terminal connected to a constant pre-set source of datum voltage and the other input terminal connected to the capacitor. The comparison is made when the voltage in the capacitor peaks, i.e. when the light beam is blocked by the next blank position of the rotary member and depending on the sign of the difference, a signal of one polarity or the other is transmitted to a controller for adjusting the yarn temperature. This adjustment is preferably a proportional one, i.e. depending on the magnitude of the difference between the two voltages, but constant steps of adjustment may be adequate. The current to the capacitor then falls to zero and it is discharged in readiness for a fresh charging and comparison cycle when radiation is again incident on the sensor with the presence of a gap.

Yarn temperature is preferably controlled by adjusting the temperature of gas or steam flowing through the jet nozzle. For this purpose, an auxiliary heating element may be included in the path of the gas or steam to the nozzle and the temperature of the heating element may be adjusted in accordance with the polarity of the signal received. Thus the temperature of the heating element may be adjustable in steps, being adjustable upwardly by one step for the receipt of a positive signal and downwardly by one step for receipt of a negative signal.

Jet operated bulking and crimping apparatus in accordance with the invention and operating in the manner just referred to, will now be described by way of example, with reference to the accompanying diagrammatic drawings, in which.

Figure 1:
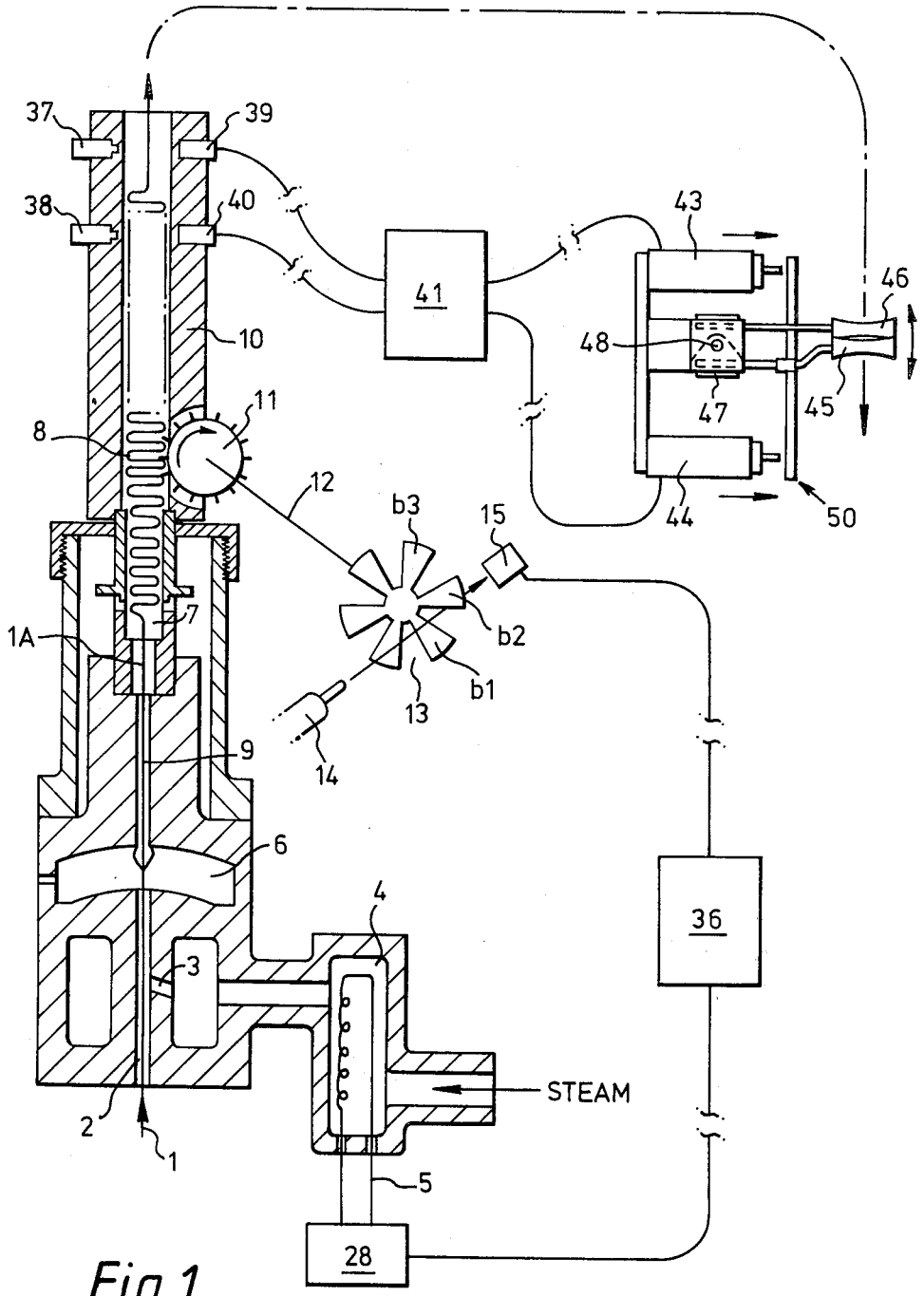
FIG. 1 is a view of the apparatus as a whole.

Thermoplastic yarn 1 enters a jet passage 2 to which high pressure steam is fed through a branch passage 3, the steam first passing through a chamber 4 in which there is located an electrical heating element 5. The high pressure steam entering the jet passage 2 carries the yarn through a domed expansion chamber 6 into a stuffer crimp chamber 7 in which the yarn is folded upon itself to form a crimp plug 8. The expansion of the steam within the expansion chamber 6 acts to separate the filaments of the yarn while its forwarding movement impacts the separated filaments against the dome of the chamber thus imparting a crimp to them.

The filaments of the thus bulked yarn 1A are then brought together again as they are carried through a connecting passage 9 by the steam into a stuffer chamber 7. The yarn impacts against the bottom of the crimp plug 8 and is folded upon itself thus being further crimped.

The crimp chamber is of tubular form and has a cooling tower extension 10 formed by longitudinally extending bars spaced around the exit of the stuffer chamber 7. The crimp plug 8 extends along the major portion of the length of the cooling tower and the yarn is drawn off the upper end of the plug, after which it passes through a tensioning device 50 seen in more detail in FIG. 2. If the yarn forming the crimp plug 8 is textured to a lesser extent than that predetermined then the plug will lengthen too rapidly and will tend to overrun the take-up speed of the apparatus withdrawing it from the cooling tower. If, on the other hand the degree of texturizing is greater than desired then the plug will gradually diminish. The extent of texturizing is controlled by apparatus about to be described, as a result of which the plug height remains substantially constant, any second order effects being compensated for by the tensioning device 50.

The control apparatus in accordance with the invention comprises a sensing wheel 11 which projects through a space between the bars of the cooling tower and engages the side of the crimp plug 8 so as to be rotated by the travel of the plug through the cooling tower. It is lightweight in construction and has short, fine pins pitched around its circumference and projecting from the face of the wheel so as to provide a positive drive between the plug and the sensing wheel. The speed of rotation of the sensing wheel is dependent on the speed of the plug and hence the degree of texturing of the yarn. The wheel 11 is connected to a gapped member in the form of a monitoring disc 13 by a shaft 12 mounted on bearings, not shown, and the blanks $b^1$, $b^2$, $b^3$ of the disc 13 control a beam of light from a source 14 which is directed on to a photo-sensor 15. The output signal from the sensor 15 is supplied to an electrical controller 36 which adjusts the temperature at which the heating element 5 will function by controlling the supply current. Hence if the plug 8 drives the wheel 11 too fast, it is an indication that the yarn is not sufficiently texturized and the electrical controller 36 will, therefore, cause an increase in the heat provided by the heating element 5. On the other hand, if the sensing wheel 11 is rotating too slowly, it is an indication that the yarn is being texturized too severely and the controller 36 will cause the heat from the element 5 to be reduced.

Figure 3:
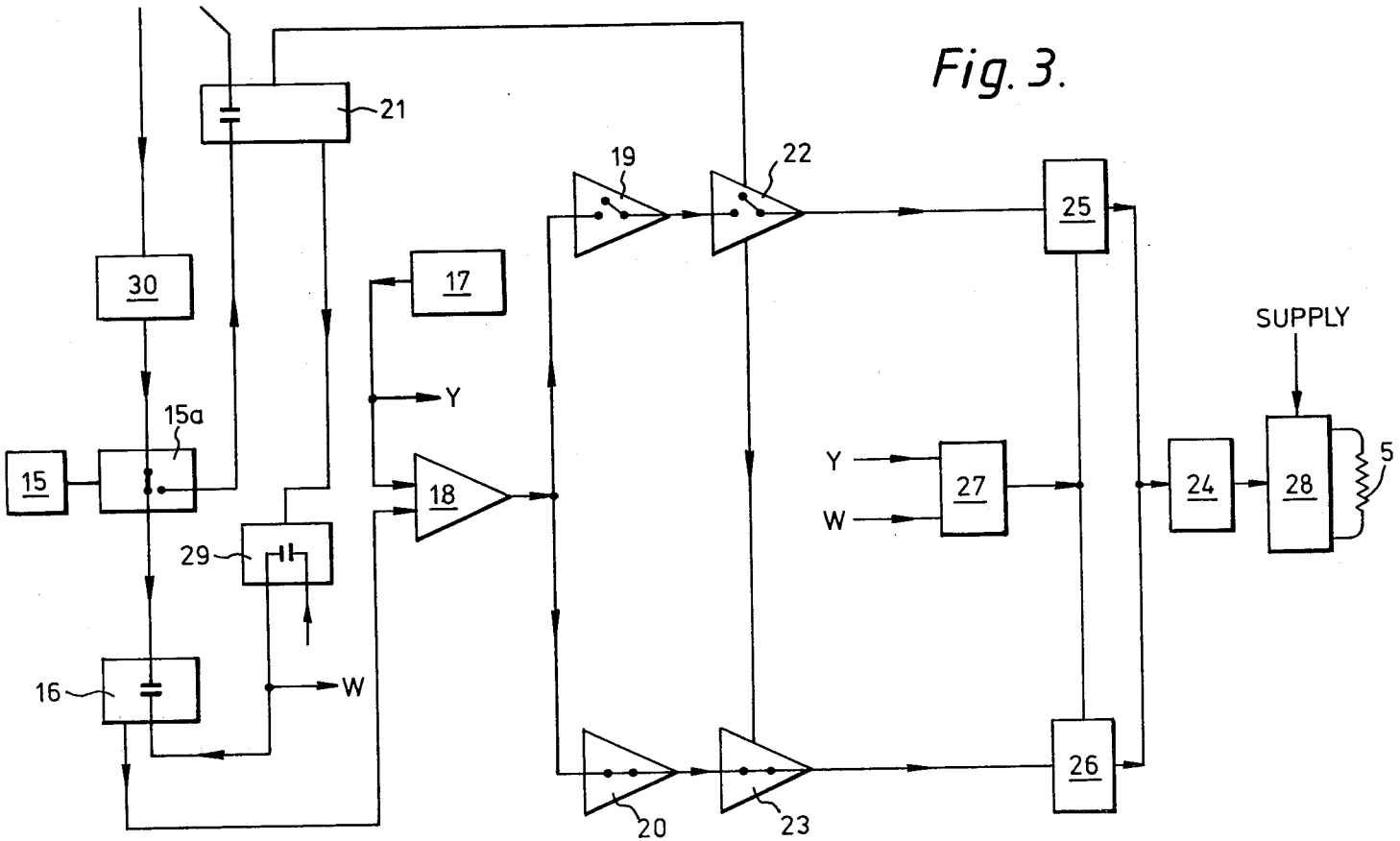
FIG. 3 is a circuit diagram.

Details of the circuit diagram of the electrical control system 36 are shown in FIG. 3. Light passing through a gap between blanks in the monitoring disc 13 reaches the photo-sensitive receiver 15 and when the light intensity exceeds a threshold value a switch 15*a* is closed to connect a source 30 of constant current to a capacitor 16 operating over the straight-line portion of its charging curve to give a linear rise in voltage with respect to time. The voltage from the capacitor 16 is compared with a pre-set datum voltage from a supply 17 by means of a comparator 18. If the period of light transmission causes the capacitor voltage to exceed the pre-set datum voltage 17, the comparator 18 will then close a "high" gate 19; unless this occurs the "high" gate will remain open and a "low" gate 20 closed.

Figure 4:
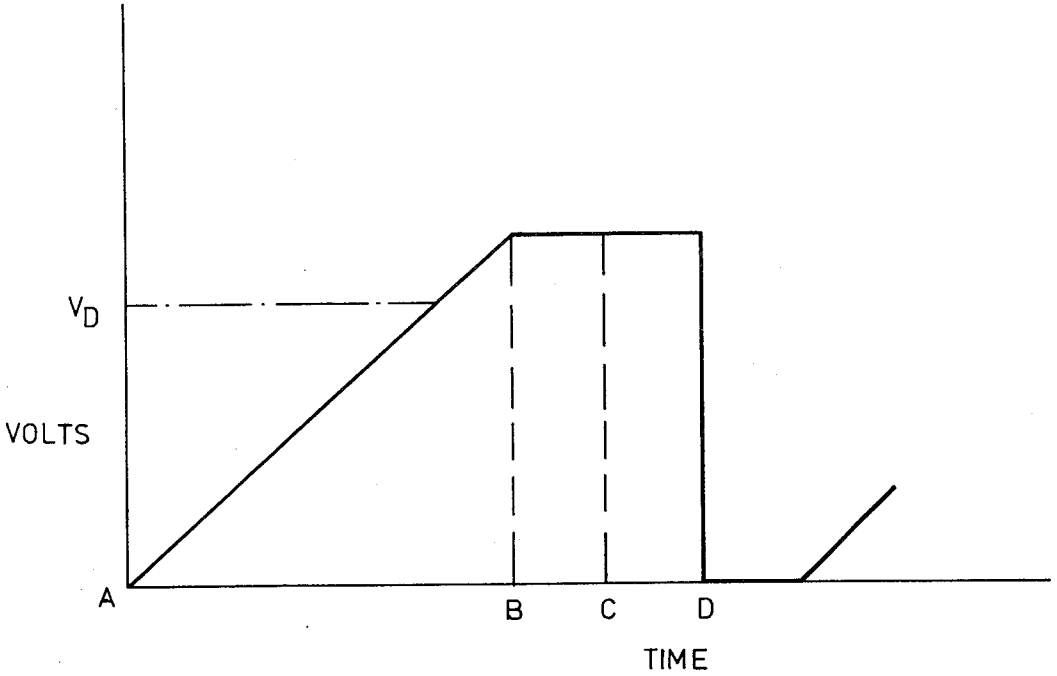
FIG. 4 is a timing diagram.

When the next blank on the monitoring disc obscures the light beam to the receiver 15 to the extent that its intensity drops below the threshold value, the switch 15*a* is tripped so as to stop the current to the capacitor 16 and the capacitor retains its voltage. The tripping of the switch 15*a* also starts a sequence timer 21. In FIG. 4, point A represents the start of the charging of the capacitor and point B represents the tripping of the switch 15*a* to interrupt charging, the datum voltage being shown as $V_D$. At time C in FIG. 4, which occurs during the black-out period when the light transmission is cut off from the receiver by the intervening blank, the sequence timer 21 closes a transmission gate 22 or 23, thus passing the comparator output signal to a voltage store 24 via increase or decrease regulators 25, 26. The regulators 25 and 26 are controlled by a proportional unit 27 supplied with the voltages from the capacitor 16 and the supply 17, shown as W and Y respectively, the adjustment occurring at time B in FIG. 4. As a consequence, the voltage store 24 receives an adjusted value of the output from the comparator which is a measure of the magnitude of the change of temperature required since the previous cycle of operation. The value of the signal passed to the voltage store determines the phase angle for the firing of a thyristor in a heater controller 28, thus regulating the heat output from the heating element 5.

At time D in FIG. 4, the sequence timer 21 briefly closes a switch 29 which discharges the capacitor 16. Since the voltage from the supply 17 remains constant the comparator 18 indicates a "below datum" condition, i.e. with the high gate 19 closed and low gate 20 open, thus preparing the system for a further cycle as soon as the photoreceiver 15 again receives light from the beam of the light emitter 14.

As a result of the control operation just described, the texturizing of the yarn will be adjusted so as to maintain substantially constant bulk and hence substantially constant height of the yarn plug 8. The rate at which the plug grows is determined by the heat supplied by the element 5 in accordance with the control operation and rate at which this growth is counteracted is determined by the speed of the take-off device (not shown) which draws the yarn from the top of the plug. In practice, it is impossible to obtain exact correlation between these two factors over long periods of time and there is thus a tendency for the plug height to change very slowly over these long periods.

This tendency is counteracted by the tension device 50 which regulates the tension applied according to the height of the plug. Since the yarn is crimped and bulked, it has appreciable resilience and any increase in tension will cause the yarn to stretch so that, for a constant linear withdrawal rate, the rate at which yarn is withdrawn from the plug is reduced. Conversely, any reduction in tension causes the rate at which yarn is withdrawn from the plug to be increased. Accordingly, the requirement is to reduce the tension for any increase of height of the plug and to increase the tension for any reduction in height.

Figure 2:
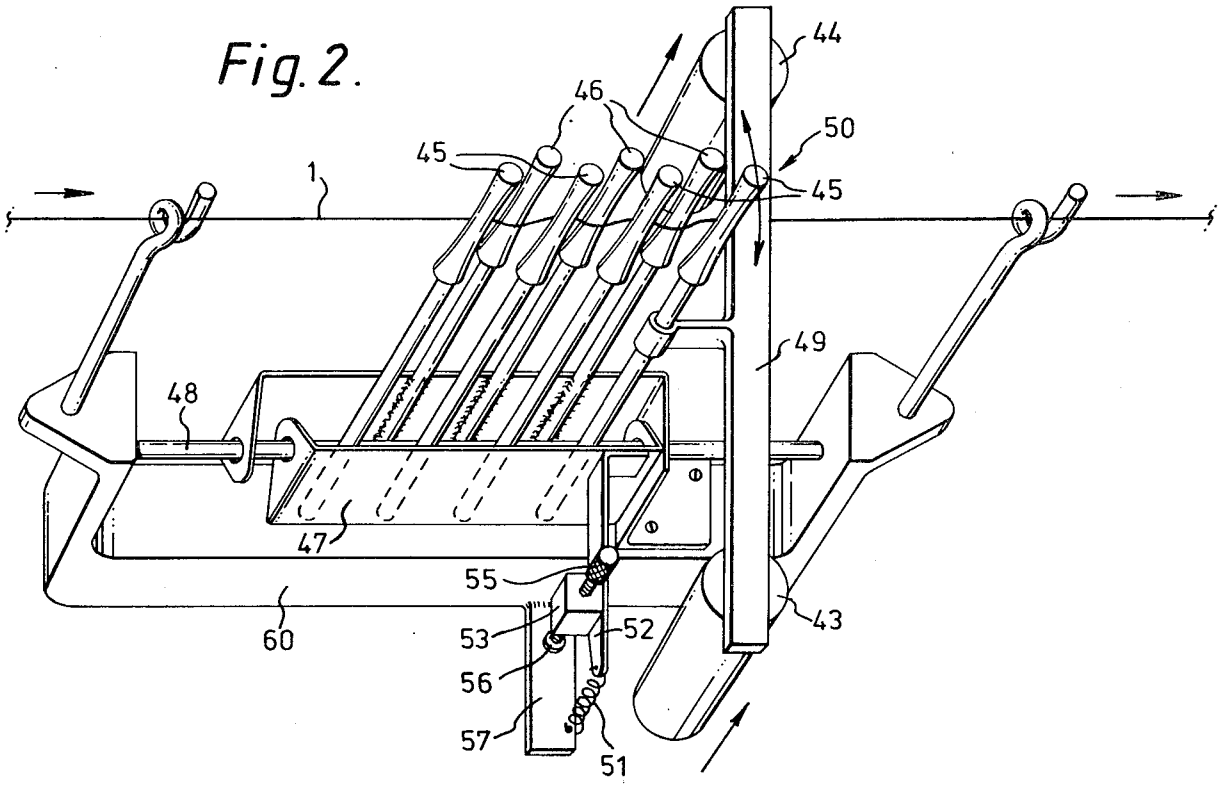
FIG. 2 is a perspective view of a tensioning device seen in FIG. 1.

As seen in FIG. 2, the tension device 50 comprises two sets of tension bars 45 and 46 which together form a gate device defining a tortuous path for the yarn 1. The set 46 of bars is fixed in position, but the other set 45 is mounted on a plate 47 pivoted about a fixed shaft 48. By rocking the set of bars 45 about the shaft 48, the extent to which this set of bars penetrates the set 46 is adjusted and this in its turn adjusts the tortuosity of the path of the yarn 1 and hence the tension applied to the yarn.

The relative setting of the bars is controlled by a lever 49 which is connected to the end bar of 45, the position of this bar being controlled by solenoids 43, 44 mounted on the body of the device. These solenoids, in their turn, are controlled by the height of the yarn plug 8 by way of a servo-controller 41 seen in FIG. 1.

The control is effected by a pair of spaced emitters 37, 38 and associated receivers 39, 40 arranged alongside the yarn plug at the upper end of the cooling tower 10. Broadly speaking, when the top of the plug drops below the emitter 38, the solenoid 44 is energized to increase the tension in the yarn and reduce the rate of withdrawal from the yarn plug and when the top of the yarn plug rises above the emitter 37, the solenoid 43 is energized to decrease the yarn tension and increase the rate of withdrawal from the yarn plug. As long as the top of the yarn plug is within the zone defined between the emitters 37 and 38, neither solenoid is energized and the bars 45 are maintained in a neutral setting as determined by the position of an adjusting screw 55 passing through a threaded block 53 mounted on an arm 52 extending from the plate 47. The lower end of the screw 55 engages a disc 56 on an extension 57 of the main supporting frame 60, the screw being pressed against the disc 56 by a tension spring 51. Under steady operating conditions, a steady tension is applied to the yarn 1, but as soon as the height of the plug departs from the limits determined by the emitters 37 and 38, the yarn tension is adjusted accordingly, energization of the solenoid 43 causing the extension 57 to yield under its own resilience and energization of the solenoid 44 stretching the spring 51. This adjusting action continues until the height of the plug is restored to a value within the zone between the emitters 37 and 38 when both solenoids are deenergized.

We claim:

1. In a method of texturizing thermoplastic yarn by forwarding it in a heated condition to a crimping zone at the entrance of a stuffer chamber so as to form a plug of crimped yarn within the chamber and controlling the movement of the yarn at the other end of the plug at a speed which is related to the input speed, the improvement which comprises deriving signals from the speed of said yarn plug in said stuffer chamber and employing said signals to control the temperature of said yarn passing to said crimping zone in such a way as to maintain the speed and hence the quality of the bulk yarn substantially constant.

2. A method according to claim 1 in which said signals are derived by comparing a value corresponding to the speed of said yarn plug with a datum value corresponding to the desired degree of bulk.

3. A method according to claim 1 or claim 2 in which a measure of the speed of said plug is obtained by means of a rotary member pressed against the side of said plug and serving to drive a second member controlling the magnitude of said signals.

4. A method according to claim 3 in which said second member is formed with gaps so as periodically to intercept a beam of radiation incident on a photo-electric sensor.

5. A method according to claim 4 in which the time during which radiation is received for each gap in said second member is measured to provide a measure of the speed of said yarn plug.

6. A method according to claim 1 in which said yarn from the end of said plug is maintained under tension which is regulated in accordance with the length of the yarn plug, whereby the effective rate of withdrawal is increased if said length increases and reduced if said length decreases.

7. In apparatus for texturizing thermoplastic yarn comprising a stuffer chamber having a crimping zone at its inlet end, means for feeding yarn at a controlled rate to the inlet end of the chamber to form a plug of crimped yarn in said chamber, which yarn exits at a controlled rate from the outlet end of the chamber, and a heater for yarn passing to the inlet end of said chamber, the improvement comprising a device for monitoring the speed of said yarn plug passing through said chamber, means for producing corresponding control signals and a control arrangement for said yarn heater for adjusting the temperature of the yarn fed to the inlet end of the chamber in response to said control signals in such a way as to maintain the speed and hence the quality of the bulk yarn substantially constant.

8. Apparatus according to claim 7 in which said feeding means for said yarn includes a jet for heated fluid or gas and said heater operates to provide auxiliary heat to the fluid or gas.

9. Apparatus according to claim 7 or claim 8 in which said speed monitoring device comprises a first rotary member for engagement with the side of said plug to be rotated thereby, a second rotary member driven by said first rotary member, and means responsive to said second rotary member for controlling the magnitude of said signals.

10. Apparatus according to claim 9 and additionally comprising a source of a beam of radiation, a photo-electric sensor receiving said beam of radiation, said second rotary member being formed with gaps and operating to periodically intercept said beam of radiation incident on said photo-electric sensor, a capacitor and means coupling said capacitor to the output from said sensor, whereby during each period of illumination when said beam of radiation is not intercepted, said sensor controls the charging of said capacitor whereby to provide a measure of the duration of each period of illumination.

11. Apparatus according to claim 10 and further including a source of constant voltage, a switch coupled between said source of constant voltage and said capacitor said switch being controlled by the output of said sensor whereby to charge said capacitor to a voltage dependent on the duration of each said period of illumination, a source of datum voltage, means for comparing said duration-dependent voltage and said datum voltage, and means responsive to the result of said comparison to adjust said control signals.

12. Apparatus according to claim 11 in which said comparing means is a comparator having two inputs, said duration-dependent voltage and said datum voltage being coupled to respective inputs of said comparator, said apparatus further including a voltage store, said comparator being coupled to said voltage store whereby to supply alternative signals to raise or lower said stored voltage depending on whether said duration-dependent voltage is higher or lower than said datum voltage, said control arrangement for said yarn heater including a thyristor and means responsive to said stored voltage for adjusting the phase angle for the firing of said thyristor.

13. Apparatus according to claim 7 and also including a device for tensioning the yarn from the end of said plug, means for determining the length of said plug and means for regulating the tension applied to said yarn in accordance with the length of said plug.

14. Apparatus according to claim 13, wherein said means for determining the length of said plug includes respective sensors for determining upper and lower values of plug length, said sensor detecting the upper value of plug length operating to reduce the tension applied to said yarn below a normal value and said sensor detecting the lower value of plug length operating to increase the tension applied to said yarn above a normal value.

15. Apparatus according to claim 14 wherein said tensioning device is in the form of a gate comprising first and second sets of bars, said bars in said first set alternating with said bars in said second set whereby to define a tortuous path for said yarn, first and second solenoids for adjusting said first and second sets of bars in relation to one another, said solenoids operating under the control of said respective sensors, whereby to adjust the degree of tortuosity of the path and hence the tension applied to the yarn.

* * * * *